United States Patent [19]

Swartzbaugh

[11] Patent Number: 4,687,112

[45] Date of Patent: Aug. 18, 1987

[54] CHILD-RESISTANT PACKAGE

[75] Inventor: Peter T. Swartzbaugh, Toledo, Ohio

[73] Assignee: Owens-Illinois, Inc., Toledo, Ohio

[21] Appl. No.: 906,884

[22] Filed: Sep. 15, 1986

Related U.S. Application Data

[62] Division of Ser. No. 764,356, Aug. 12, 1985, Pat. No. 4,613,051.

[51] Int. Cl.[4] ..... B65D 55/02

[52] U.S. Cl. ..... 215/216

[58] Field of Search ..... 215/201, 216, 330

[56] References Cited

U.S. PATENT DOCUMENTS 3,233,769 2/1966 Jessop ..... 215/216

*Primary Examiner*—George T. Hall

*Attorney, Agent, or Firm*—Howard G. Bruss

[57] ABSTRACT

A child-resistant package that includes a wide mouth blown glass container or blow molded plastic container, and a molded thermoplastic closure that is affixed to the finish portion of such container. The finish portion of the container has a radially outwardly projecting flange at the bottom portion of such finish portion, and this flange has a notch in its outer periphery. The closure has a flexible projection that extends outwardly and downwardly from the skirt of the closure, and a portion of this projection engages the notch in the flange of the finish to prevent the turning of the closure on the finish. The projection of the closure can be manipulated by hand to remove the portion of the projection that engages the notch in the container finish to disengage the closure projection from the container finish notch, to permit the removal of the closure from the container. In one embodiment, the closure is normally retained on the container finish by means of a snap-on bead that projects inwardly from the closure skirt and engages a locking bead that projects outwardly from the container finish. In an alternative embodiment, the container finish is provided with an outwardly projecting helical thread, and the closure is provided with an inwardly projecting helical thread that engages the helical thread of the container finish.

7 Claims, 9 Drawing Figures

CHILD-RESISTANT PACKAGE

This is a division of application Ser. No. 764,356, filed Aug. 12, 1985, now U.S. Pat. No. 4,613,051.

BACKGROUND OF THE INVENTION

1. FIELD OF INVENTION

This invention relates to a package which includes a container and a closure that is affixed to the container. The closure requires special manipulation for removal from the container to be resistant to removal by children and to thereby help to prevent the accidental ingestion of the contents of the package. In particular, the invention relates to a child-resistant package of the aforesaid type in which the container is of wide mouth type. The invention is shown in a version in which the closure is of the screw-on type. The container may be formed of glass or plastic and the closure is a molded thermoplastic closure.

2. DESCRIPTION OF THE PRIOR ART

Various container/closure packages are known in the prior art which are resistant to opening by a child to prevent the accidental ingestion of the contents of the package. Many of the more popular applications for such child-resistant packaging involve containers of the type which have relatively small openings, such as small-mouth containers which are used in the packaging of liquids, for example, cough syrup, other liquid medications, and various liquid cleaning products, and pharmaceutical vials for the packaging of various tablets and other dry products. U.S. Pat. Nos. 3,795,388 (Swartzbaugh, et al.) 3,857,505 (Mumford, et al.) and 3,926,326 (Grau) illustrate child-resistant packages of this type.

Various products which are dangerous when ingested, or when ingested in excessive amounts, cannot be satisfactorily packaged in a small-mouth container, however, and various of the designs of child-resistant closures which have proven to be satisfactory for small-mouth containers cannot be satisfactorily adapted for use with a wide mouth container. U.S. Pat. No. 4,375,859 (Fillmore) does describe a child-resistant package in which the container is of the wide mouth type, but this closure is of the snap-on type. In certain packaging applications it is preferable to use a threaded or screw-on closure, and in these applications a snap-on child-resistant closure of the type described in U.S. Pat. No. 4,375,859 is unsatisfactory, at least in part.

SUMMARY OF THE INVENTION

In accordance with the present invention there is provided a child-resistant container/closure package in which the container may be of the wide mouth type, that is, with a container finish diameter, viz., with a container "T" dimension (the approximate outside diameter of the container thread, in the case of a threaded finish container, or the approximate outside diameter of the container locking bead in the case of a container that is designed to receive a snap-on closure) of at least 43 mm. A container to be used in the container/closure package of the present invention is provided with a discontinued circumferential locking flange that extends radially outwardly from the wall of the finish, a notch being formed in the discontinued portion of the locking flange. The closure of the container/closure package of the present invention is molded from thermoplastic material, such as high density polyethylene or polypropylene, and the closure skirt has a resilient projection that extends radially outwardly therefrom with a portion that extends downwardly to normally fit in the notch of the locking of the container finish to prevent the closure from being turned on finish. The downwardly extending portion of the resilient projection of closure skirt has sufficient flexibility to be lifted out of the notch the finished locking bead to permit the closure to be turned on the finish, an action which inherently is needed to remove a screw-type closure. The snap-on closure embodiment of the closure/container package of the present invention also requires a turning action, subsequent to the lifting of the projection on the closure, to effect the removal of the closure from the container as the circumferential locking bead of the container is also discontinued to form a notch and the closure is provided with an inwardly extending tab that lies under the locking bead and interferes with the removal of the closure, except when the tab is aligned with the of the locking bead. The locations of the notch in the locking bead of the finish and the tab of the closure are such that they are not in alignment when the resilient projection and notch in the closure flange are in alignment, thus, requiring a turning of the closure after the disengagement of the resilient projection of the skirt from the flange of the finish. Consequently, in both of the embodiments of the invention, at least two manipulative actions are required before the closure can be removed from the finish of the container, the disengagement of the resilient projection on the closure skirt from the notch in the flange of the container finish, followed by a turning of the closure. The complexity of these manipulations help to prevent the accidental opening of the package by a child, therefore, permitting substances to be packaged in the container which would be dangerous if accidentally consumed, either by virtue of the nature of any such substance and/or by virtue of the volume of the substance that is packaged in the container.

Accordingly, it is an object of the present invention to provide an improved child-resistant container/closure package.

It is a further object of the present invention to provide a child-resistant container/closure package that may utilize a wide mouth container.

It is a further object of the present invention to provide a child-resistant container/closure package in which the container is of the wide mouth type and in which the closure may be mass produced relatively inexpensively by the molding of a thermoplastic material.

It is a further object of the present invention to provide a child-resistant container/closure package in which the container is of the wide mouth type and is readily formable from glass or plastic by various of the known glass container and plastic container manufacturing techniques.

It is also an object of the present invention to provide a child-resistant container/closure package in which the container is of the wide mouth type, and in which the closure is a molded thermoplastic closure, and which may be repeatedly opened and closed without undue degradation of performance characteristics through fatigue.

For a further understanding of the invention and the objects thereof, attention is directed to the drawing and the following description thereof, to the detailed description of the preferred embodiment and to the appended claims.

DETAILED DESCRIPTION OF THE PREFERRED EMBODIMENT

Figure 3:
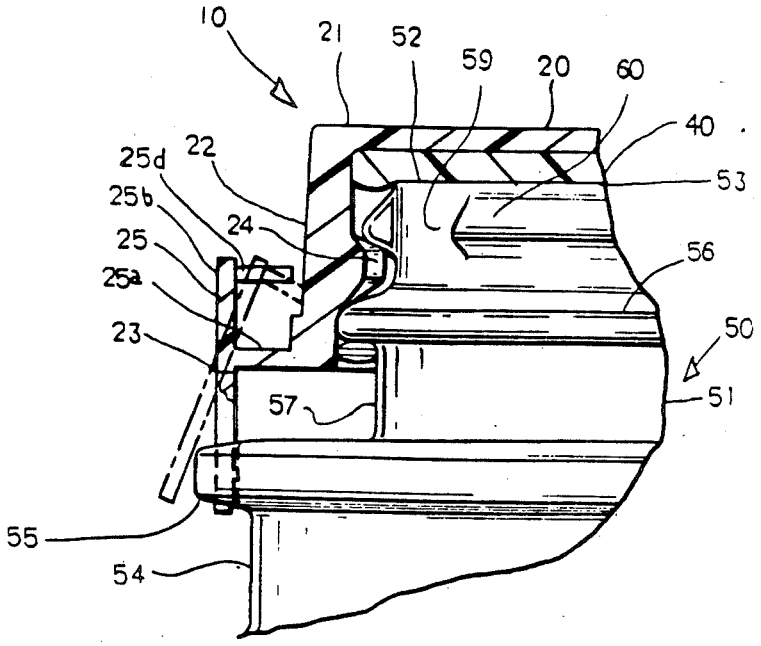
FIG. 3 is a fragmentary sectional view taken on line 3—3 of FIG. 1.
Figure 4:
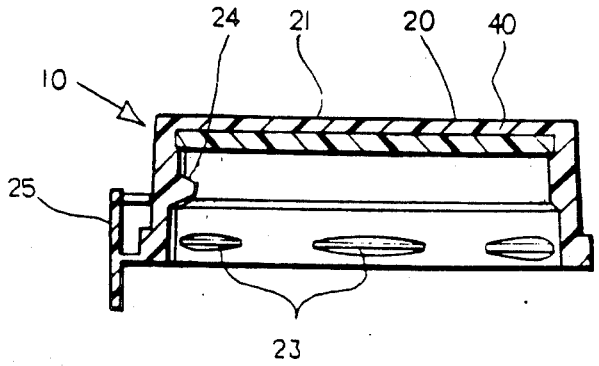
FIG. 4 is a cross-sectional view of the closure depicted in FIGS. 1 through 3.
Figure 5:
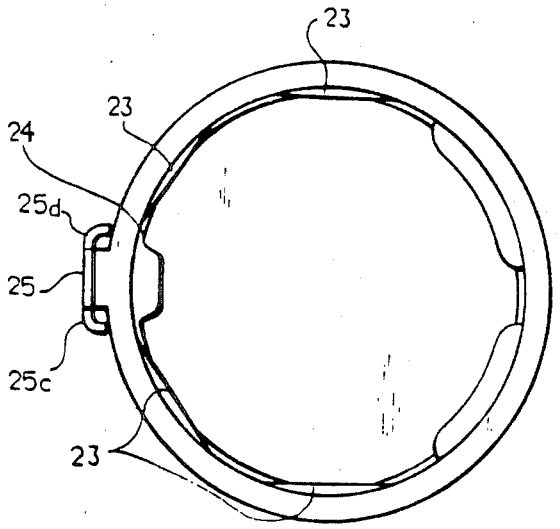
FIG. 5 is a bottom plan view of the closure of FIGS. 1 through 4.
Figure 6:
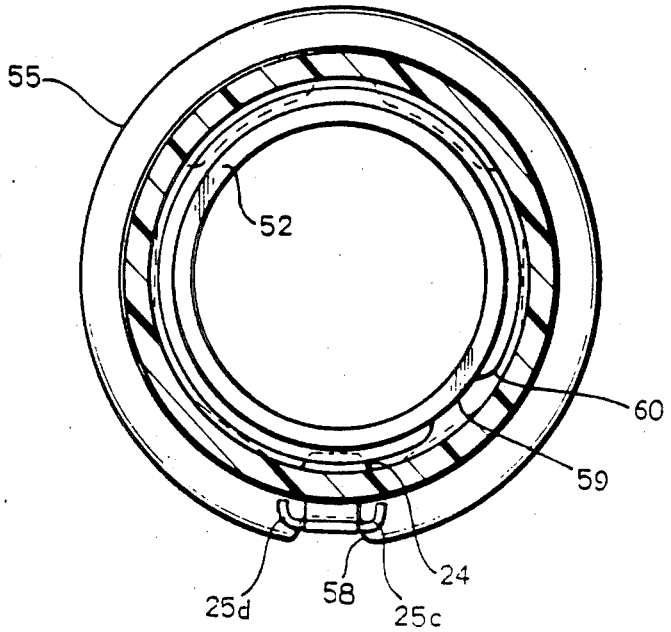
FIG. 6 is a sectional view taken on line 6—6 of FIG. 2.

The child/resistant package according to the present invention is made up of a closure, indicated generally by reference numeral 10, and a container, shown fragmentarily, and indicated generally by reference numeral 50. As is shown in FIGS. 3 and 4, the closure 10 is made up of the closure body 20 and a liner 40. The closure body 20 is preferably molded in a single piece, as by injection molding or compression molding, from a suitable thermoplastic material, such as high density polyethylene or polypropylene. The liner 40 may be formed from pulp or suitable plastic material, so long as it will form a suitable seal on the rim of the container 50 and will be compatible with the product to be packaged in the container 50. The container 50 is a wide mouth container (i.e. with a container "T" dimension of 43 mm or greater), and may be considered to be either a blown glass container or a blow molded thermoplastic container, the selection of the material for container 50 normally being based on the susceptibility of the contents of the container to attack by oxygen or other ingredients of air which may permeate through the wall of a plastic container, or infra-red or ultra-violet radiation which may pass through the wall of a glass container, all as is well understood in the art.

The container 50 has a neck or "finish" portion 51 that defines an upper open mouth 53 of the container 50, the finish portion 51 terminating in a rim 52. The container 50 also has a body portion 54, and the body portion 54 is separated from the finish portion 51 by means of a radially outwardly projecting flange 55. As is clear from FIG. 3, the radial extent of the radially outwardly projecting flange 55 is greater than the radial extent of any other portion of the finish 51.

The container 50 is of the type which is adapted to be closed by means of a primary locking bead 56, which is horizontally disposed when the container 50 is in an upright position and is located between the rim 52 of the container and the radially outwardly projecting flange 55. The primary locking bead 56 is preferably endless in character, and as is clear from FIG. 3, it projects radially outwardly beyond an inner wall 57 of the finish 51. In customary container/closure nomenclature, the outside diameter of the wall 57 of the finish 51 is known as the "E" dimension of the container, and in a container which is adapted to receive a snap-on closure, the outside diameter of the primary locking bead 56 of the container finish 51 is known as the "T" dimension of the container. As was stated above, the present invention is ideally suited for containers whose "T" dimension is equal to or greater than 43 mm, a dimension which indicates such container is of the "wide-mouth" type.

Figure 1:
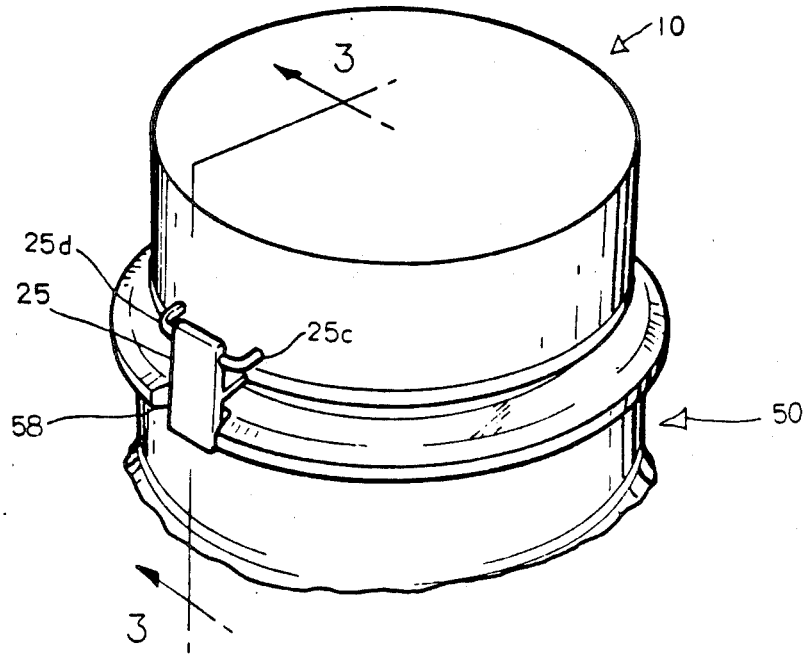
FIG. 1 is a fragmentary perspective view of the preferred embodiment of a package according to the present invention, the package including a container and a closure affixed thereto.
Figure 2:
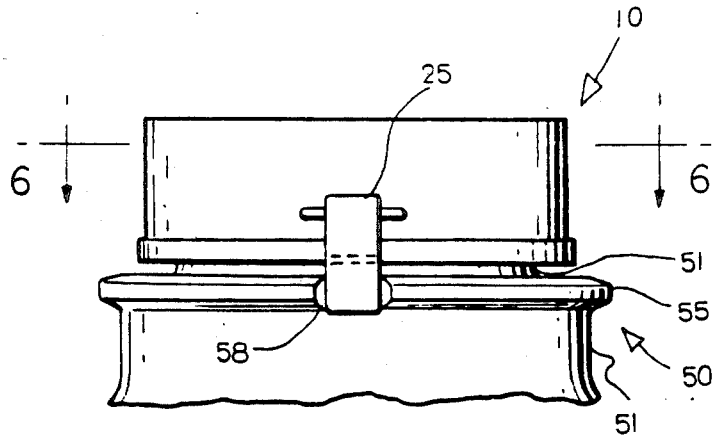
FIG. 2 is a fragmentary front elevational view of the package of FIG. 1.

As is clear from FIGS. 1 and 2, a peripheral portion of the radially outwardly projecting flange 55 is discontinued to define an outwardly facing notch 58, and the notch 58 is circumferentially offset with respect to a notch 59 in a double-ended secondary locking bead 60 that is located between the primary locking bead 56 and the rim 52 of the finish 51.

The closure body 20 is made up, in general, of a top panel 21 that spans the upper open mouth 53 of the container 50, and an annular skirt 22 that extends downwardly from the top panel 21 to surround the upper portion of the finish 51 of the container, including the secondary locking bead 60 and the primary locking bead 56. The closure 10 is normally held in place on the finish 51 of the container 50 by means of a circumferential series of locking lugs 23 which project radially inwardly from the annular skirt 22, from locations near the bottom thereof, to form an interference fit with the underside of the primary locking bead 56 of the container finish 51 when the closure 10 is affixed to the container 50. The degree of the interference between the lugs 23 and the primary locking bead 56 of the container 50 is such that the closure 10 can be snapped onto and off of the finish 51 of the container 50 by hand, without requiring a special tool to assist in the opening and the closing of the container.

The annular skirt 22 of the closure body 20 is also provided with a radially inwardly projecting tab 24 that is adapted to bear on the underside of the secondary locking bead 60 in an interference fit therewith such that the closure 10 cannot ordinarily be snapped on and off of the finish 51 of the container 50 when the tab 24 is in an interference fit with the secondary locking bead 60 because of the magnitude of such interference. However, once the closure 10 is rotated relative to the finish 51 of the container 50 to bring the radially inwardly projecting tab 24 into alignment with the notch 59 in the secondary locking bead 60, there is no interference between the radially inwardly projecting tab 24 and the secondary locking bead 60, or at least no interference of a magnitude that would interfere with the removal of the closure 10, and in a case where there is no interference between the radially inwardly projecting tab 24 and the secondary locking bead 60, the only interference fit between the closure 10 and the container 50 is that which is provided by the locking lugs 23 and the primary locking bead 56 which, as was above explained, is insufficient to prevent the removal of the closure 10 from the container 50 by hand, or the subsequent reapplication of the closure 10 to the container 50 by hand.

Figure 7:
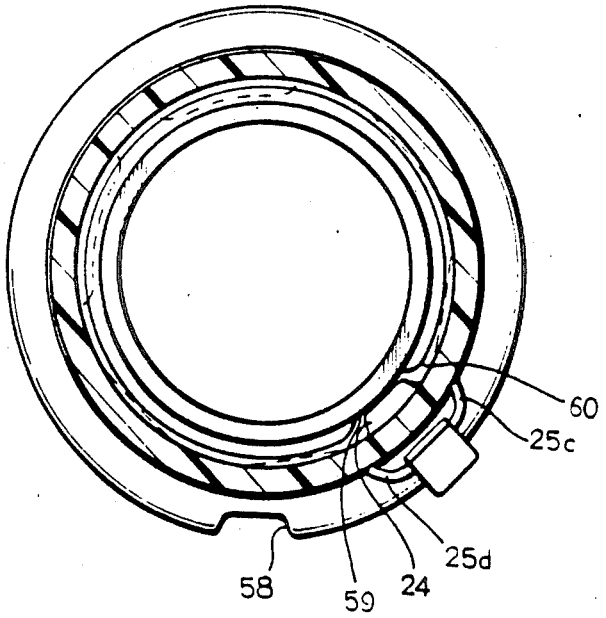
FIG. 7 is a view similar to FIG. 6 in which the closure has been turned relative to the container to permit the opening of the package.

The closure 10 is normally maintained in a position with the radially inwardly projecting tab 24 out of alignment with the notch 59 in the secondary locking bead 60 and, therefore, in a position where it cannot normally be removed by hand, by means of a projection 25 which is formed intergrally with the closure body 21 and extends radially outwardly from the annular skirt 22, and downwardly below the bottom of the annular skirt 22 to engage the notch 58 in the radially outwardly projecting flange 55. As is most clearly shown in FIG. 3, the projection 25 is made up of a first portion 25*a* which extends radially outwardly from the annular skirt 22, and a second portion 25*b* which extends generally vertically upwardly and downwardly from the first portion 25*a*. The second portion 25*b* of the projection 25 can be pivoted relative to the first portion 25*a* by hand pressure, as is indicated by the phantom line in FIG. 3, to rotate the bottom of the second portion 25*b* outwardly from the notch 58 in the radially outwardly projecting flange 55, and when this is done, the closure 10 can be rotated on the finish 51 of the container 50 to bring the inwardly projecting tab 24 into alignment with the notch 59 in the secondary locking bead 60, as is shown in FIG. 7. The projection 25 also includes fingers 25*c* and 25*d* extending inwardly from the upper end of the second portion 25*b*. When the second portion 25*b* of the projection 25 is pivoted to remove the bottom portion thereof from the notch 58, the fingers 25*c* and 25*d* will contact the extension of the annular skirt 22 of the closure body 21, and will be wedged apart by such contact. Such wedging apart of the fingers 25*c* and 25*d* will create a biasing force on the second portion 25*b* of the projection 25, which will help to insure a return of the second portion 25*b* into its normal position, in interference with the notch 58, upon the removal of hand pressure from the second portion 25*b* of the projection 25 and the re-orientation of the closure 10 so that the projection 25 is radially aligned with the notch 58 in the flange 55.

Figure 8:
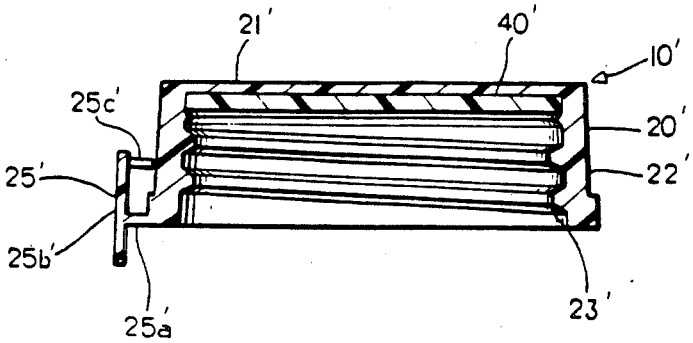
FIG. 8 is a view similiar to FIG. 4, of an alternative embodiment of a closure according to the present invention.
Figure 9:
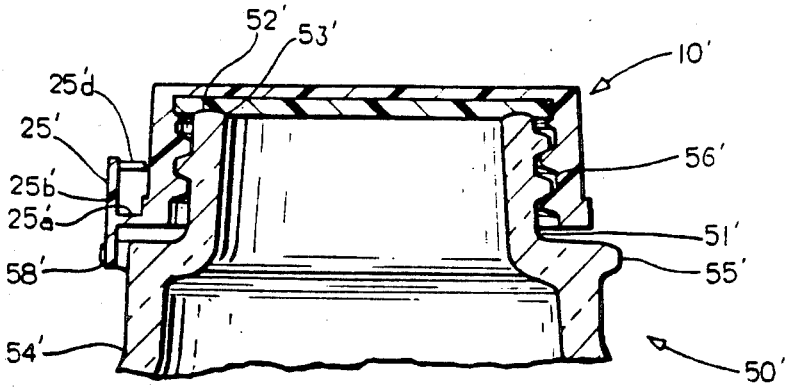
FIG. 9 is a view similiar to FIG. 3 showing the closure of FIG. 8 on a container shown fragmentarily.

FIGS. 8 and 9 depict an alternative embodiment of the child-resistant package according to the present invention, such package including a closure, indicated generally by reference numeral 10′, and a container, shown fragmentarily and indicated generally by reference numeral 50′. The closure 10′ is made up of a closure body 20′ and a liner 40′. The closure body 20′ is preferably molded in a single piece, as by injection molding or compression molding, from a suitable thermoplastic material, such as high density polyethylene or polypropylene. The liner 40′ may be formed from a suitable plastic material, so long as it will form a suitable seal on the rim of the container 50′ and will be compatible with the product to be packaged in the container 50′. The container 5040 is a wide mouth container, for example, either a blown glass container or a blow molded thermoplastic container.

The container 50′ has a neck or finish portion 51′ that defines 20 an upper open mouth 53′ of the container 50′, the finish portion 51′ terminating in a rim 52′. The container 50′ also has a body portion 54′, and the body portion 54′ is separated from the finish portion 51′ by means of a radially outwardly projecting flange 55′. As is clear from FIG. 9, the radial extent of the radially outwardly projecting flange 55′ is greater than the radial extent of any other portion of the finish 51′.

The container 50′ is of the type which is adapted to be closed by a threaded closure, and to engage such a closure the finish 51′ of the container 50′ has a helical thread 56′ projecting radially outwardly therefrom. The helical thread 56′ is located between the rim 52′ of the container 50′ and the radially outwardly projecting flange 55′.

The closure body 20′ is made up, in general, of a top panel 21′ that spans the upper open mouth 53′ of the container 50′, and an annular skirt 22′ that extends downwardly from the top panel 21′ to surround the upper portion of the finish 51′ of the container, including the helical thread 56′. The closure 10′ is normally held in place on the finish 51′ of the container 50′ by means of a helical thread 23′ which projects radially inwardly from the annular skirt 22′, to engage the helical thread 56′ on the finish 51′ of the container 50′ to form a screw-on and screw-off fit between the closure 10′ and the container 50′.

Child-resistant opening characteristics are imparted to the package of FIGS. 8 and 9 by providing an outwardly facing notch 58′ in the radially outwardly projecting flange 55′, and by providing the closure 10′ with a projection 25′ that is adapted to engage a notch 58′ in the radially outwardly projecting flange 55′ of the container 50′ when the closure 10′ has been fully screwed onto the finish 51′ of the container 50′. The projection 25′ of the closure 10′ is made up of a first portion 25*a*′ which extends radially outwardly from the annular skirt 22′, and a second portion 25*b*′ which extends generally vertically upwardly and downwardly from the first portion 25*a*′. The second portion 25*b*′ of the projection 25′ can be pivoted relative to the first portion 25*a*′ by hand pressure, to rotate the bottom of the second portion 25*b*′ outwardly from the notch 58′in the radially outwardly projecting flange 55′ and, when this is done, the closure 10′ can be rotated on the finish 51′ of the container 50′ to unscrew the closure 10′ from the container 50′.

The projection 25′ also includes a pair of fingers, only one of which, 25*c*′, is shown in the drawing in FIGS. 8 and 9. The fingers, including the finger 25*c*′, extend inwardly from the upper end of the second portion 25*b*′, and when the second portion 25*b*′ of the projection 25′ is pivoted to remove the bottom portion thereof from the notch 58′, the fingers, including the finger 25*c*′, will contact the exterior of the annular skirt 22′ of the closure body 21′, and will be wedged apart by such contact. Such wedging apart of the fingers, including the finger 25*c*′, will create a biasing force on the second portion 25*b*′ of the projection 25′, and this will help to insure a return of the second portion 25*b*′ *into its normal position in interference with the notch 58′, upon the removal of hand pressure of the second portion 25b*′ of the projection 25′ and the reorientation of the closure 10′ so that the projection 25′ is radially aligned with the notch 58′.

Although the best mode contemplated by the inventor for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. A child-resistant package comprising, in combination:

a container having a central axis and comprising an open mouth and a finish surrounding said open mouth, said finish of said container comprising:

helical thread means projecting radially outwardly from said finish; and a flange projecting radially outwardly from said finish, the radial extent of said flange being greater than the radial extent of said helical thread means, said flange being axially spaced further along said central axis from said open mouth of said finish than said helical thread means and having at least a peripheral portion which is interrupted to define a notch in said flange between the interrupted portions thereof, a closure surrounding and removably engaging said finish and closing said open mouth of said container, said closure comprising:

a top panel spanning the open mouth of the container;

a skirt affixed to said top panel and extending therefrom generally parallel to said central axis of said container to surround said first annular bead of said finish;

helical thread means affixed to said skirt and extending radially inwardly therefrom, said helical thread means of said closure being engageable with said helical thread means of said container to permit said closure to be screwed onto and unscrewed from said finish of said container; and a resilient projection affixed to said skirt and extending radially outwardly and downwardly therefrom, the circumferential extent of said resilient projection being less than the circumferential extent of said notch in said flange, said resilient projection extending axially downwardly to a position which is spaced further along said central axis from said open mouth of said finish than said flange, said resilient projection clearing said finish when circumferentially aligned with said notch in said flange and being normally disposed radially inwardly of the outside of said flange to inhibit the turning of said closure on said finish in any direction when said resilient projection is circumferentially aligned with said notch in said flange, said resilient projection being elastically deformable to a position which does not inhibit the turning in any direction of said closure on said finish.

2. A child-resistant package according to claim 1 wherein said top panel, said skirt, said tab and said resilient projection of said closure are integrally molded in a single piece from a thermoplastic material.

3. A child-resistant package according to claim 2 wherein the major ingredient of said thermoplastic material is selected from the group consisting of high density polyethylene and polypropylene.

4. A child-resistant package according to claim 1 wherein said container is a wide mouth container having a finish diameter of at least 43 mm.

5. A child-resistant package according to claim 2 wherein said resilient projection of said closure comprises a first portion and a second portion, said first portion extending radially outwardly from said skirt, said second portion extending generally vertically upwardly and downwardly from said first portion.

6. A child-resistant package according to claim 5 wherein said resilient projection further comprises finger means extending inwardly from said second portion at a location above said first portion, said finger means being engagable with said finish of said container when said resilient projection has been elastically deformed to said position which does not inhibit the turning of said closure on said finish to create a biasing force that will tend to return said resilient projection to a position which does inhibit the turning of said closure on said finish.

7. A child-resistant package according to claim 6 wherein said second portion has a first end and a second end and wherein said finger means extends inwardly from said second portion at a location adjacent one of said first end and said second end.

* * * * *